US010287085B2

(12) United States Patent
Kuhn

(10) Patent No.: US 10,287,085 B2
(45) Date of Patent: May 14, 2019

(54) TRANSPORT CONTAINER SYSTEM AND METHOD

(71) Applicant: VA-Q-TEC AG, Würzburg (DE)

(72) Inventor: Joachim Kuhn, Würzburg (DE)

(73) Assignee: VA-Q-TEC AG, Würzburg (DE)

( * ) Notice: Subject to any disclaimer, the term of this patent is extended or adjusted under 35 U.S.C. 154(b) by 0 days.

(21) Appl. No.: 15/302,601

(22) PCT Filed: Apr. 10, 2015

(86) PCT No.: PCT/EP2015/000760
§ 371 (c)(1),
(2) Date: Oct. 7, 2016

(87) PCT Pub. No.: WO2015/180808
PCT Pub. Date: Dec. 3, 2015

(65) Prior Publication Data

US 2017/0073147 A1 Mar. 16, 2017

(30) Foreign Application Priority Data

May 30, 2014 (DE) ..... 20 2014 004 395 U
Jun. 5, 2014 (DE) ..... 20 2014 004 515 U

(51) Int. Cl.
*B65D 81/38* (2006.01)
*F25D 3/06* (2006.01)
(Continued)

(52) U.S. Cl.
CPC ..... *B65D 81/3823* (2013.01); *B65D 43/02* (2013.01); *B65D 81/3825* (2013.01);
(Continued)

(58) Field of Classification Search
CPC ..... F25D 3/06; F25D 3/08; F25D 2331/804; F25D 2303/0844; F25D 2303/08222;
(Continued)

(56) References Cited

U.S. PATENT DOCUMENTS 5,555,980 A * 9/1996 Johnston ..... B65D 19/18 206/386
5,899,088 A * 5/1999 Purdum ..... B65D 81/056 62/371
(Continued)

FOREIGN PATENT DOCUMENTS

DE 20301839 7/2003
DE 102012006743 10/2013
(Continued)

OTHER PUBLICATIONS

International Search Report, PCT/EP2015/000760, dated Jun. 29, 2016.
(Continued)

*Primary Examiner* — Melvin Jones
(74) *Attorney, Agent, or Firm* — Andrus Intellectual Property Law, LLP

(57) ABSTRACT

A transport-container system has at least one container with a base, a casing and a top, and having inner-wall elements, which are arranged on the inner surfaces of the walls of the container and can be removed from the container and inserted into the container. Each inner-wall element has predetermined dimensions matching those of the associated inner surface of the container. At least as far as some of the inner-wall elements are concerned, the transport-container system has a number of embodiments with at least substantially the same dimensions, wherein it is possible to insert optionally one of the embodiments of inner-wall elements at the position in the container which is envisaged for the relevant inner-wall element. A method is for providing a container of a transport-container system with correspondingly different embodiments of inner-wall elements.

14 Claims, 4 Drawing Sheets

(51) Int. Cl.
*B65D 43/02* (2006.01)
*F25D 3/08* (2006.01)

(52) U.S. Cl.
CPC ..... *F25D 3/06* (2013.01); *F25D 3/08* (2013.01); *F25D 2201/14* (2013.01); *F25D 2303/0843* (2013.01); *F25D 2303/0844* (2013.01); *F25D 2303/0845* (2013.01); *F25D 2303/08222* (2013.01)

(58) Field of Classification Search
CPC ..... F25D 2201/14; F25D 2303/0843; B65D 81/3813; B65D 25/2897; B65D 43/16
USPC ..... 62/371, 457.1, 457.2, 530
See application file for complete search history.

(56) References Cited

U.S. PATENT DOCUMENTS 6,325,281 B1 * 12/2001 Grogan ..... B65D 81/3862 220/592.25
6,666,032 B1 * 12/2003 Rickson ..... A61J 1/165 62/3.6
7,963,397 B2 * 6/2011 Seagle ..... B65D 19/18 206/600
2004/0231355 A1 * 11/2004 Mayer ..... C09K 5/063 62/371
2006/0230778 A1 * 10/2006 Williams ..... B65D 81/3862 62/371
2006/0277938 A1 * 12/2006 Meyer ..... F25D 11/003 62/371
2009/0078708 A1 3/2009 Williams
2010/0072211 A1 * 3/2010 Dickinson ..... B65D 43/16 220/592.27
2010/0147837 A1 * 6/2010 Williams ..... B65D 81/3862 220/1.5
2010/0326993 A1 * 12/2010 Mayer ..... B65D 81/3825 220/592.27
2011/0248038 A1 * 10/2011 Mayer ..... B65D 81/382 220/592.27

FOREIGN PATENT DOCUMENTS

| | | |
|---|---|---|
| EP | 2221569 | 8/2010 |
| EP | 2602208 | 6/2013 |
| EP | 2700891 | 2/2014 |
| JP | 2007-22598 | 2/2007 |
| JP | 2010-525996 | 7/2010 |
| WO | 2004104498 | 12/2004 |
| WO | 2008/137883 | 11/2008 |

OTHER PUBLICATIONS

Themeninfo IV/02 aus dem Jahre 2002 (Focus IV/02 from Identifier 0329840A-D, www.bine.info, search term “Latentwarmespeicher”, website visited Oct. 7, 2016.
Japanese Office Action, English Translation, Japanese Patent Application No. 2016-570261, dated Jul. 17, 2018.

* cited by examiner

TRANSPORT CONTAINER SYSTEM AND METHOD

CROSS-REFERENCE TO RELATED APPLICATIONS

This application is the U.S. national stage application of International Application PCT/EP2015/000760, filed Apr. 10, 2015, which international application was published on Dec. 3, 2015, as International Publication WO 2015/180808 in the English language. The International Application claims priority of German Patent Application No. 202014004395.7, filed May 30, 2014 and German Patent Application No. 202014004515.1, filed Jun. 5, 2014. The international application and German applications are all incorporated herein by reference, in entirety.

FIELD

The invention relates to a transport container system, and a method for equipping a container of a transport container system.

BACKGROUND

In principle, the subject matter is a transport container system whereof the basic component is first of all a container that has a base, a casing and a lid. A container of this kind may be cubic or cuboid in form. In that case, the casing has longitudinal walls and transverse walls. The container may also be cylindrical or tubular in form. In that case, the casing has a cylindrical shape. The casing may be made in one piece with the base. The essential point is that at least one lid is present so that the interior of the container is accessible from the outside. A lid, in this context, may also be a laterally arranged door if, instead of a trough-like container that is upwardly closed by a lid, it is a cabinet-like container that is forwardly closed by a door.

The transport container system includes at least one container and an appropriate number of inner wall elements. However, it is also possible for a transport container system to include a plurality of containers having a correspondingly greater number of inner wall elements. In the case of a plurality of containers, the containers may have the same size and shape as one another or have different sizes and/or shapes.

A transport container system having a corresponding thermally insulated container is known from WO 2004/104498 A2. In this case, the container takes the form of a cabinet having an outer container, made from sheet metal or plate-like plastics material, and an inner container that is fitted inside the outer container. The inner container is formed by inner container wall elements that take the form of thermal insulation elements. All these inner container wall elements are in this case vacuum insulation panels. These are the thermal insulation elements with the best performance at present. We may refer the reader specifically to the content disclosed in this specification, which is a prior publication, and from which many aspects of transport containers of the type in question become apparent.

The transport container that is known from the prior art discussed above has a plurality of insert guides in the interior. A number, suitable for the intended purpose, of cooling packs or latent heat storage elements may be inserted into the insert guides. To this extent too, we may refer the reader to the content disclosed in this citation.

A latent heat storage element is based on the utilization of latent heat storage material. A latent heat storage material has the advantage that it can be used to store relatively large quantities of heat with a small temperature difference. Since the phase transition takes place at substantially constant temperature over a certain time span, it is possible to equalize temperature fluctuations and avoid temperature peaks.

Latent heat storage materials are known in various forms. These materials are also called PCM materials (from the English term "phase change material").

If a target temperature (temperature of the phase transition) is around 0° C., water having different additives may be used as latent heat storage material. For cold storage below 0° C., suitably prepared salt solutions for example may be used.

In the range just above 0° C., other materials, such as those based on paraffin, are more suitable.

As background, the reader is specifically referred to the overview article from the BINE Information Service, "Themeninfo IV/02 aus dem Jahre 2002 [Focus IV/02 from 2002]", (Fachinformationszentrum Karlsruhe, project identifier 0329840A-D, available at *www.bine.info*, search term "Latentwärmespeicher"). The reader is hereby referred to the content of this literature reference for a general background in latent heat storage materials and their possible uses.

A latent heat storage element according to the present invention is a latent heat storage material in a closed sheathing, where appropriate provided with a pressure equalization valve. This is also called a macro-encapsulated PCM material. The sheathing is frequently made from plastics material. The basic construction of, for example, so-called cooling packs is known.

Latent heat storage elements of this kind may be considered individually or also as a plurality of latent heat storage elements, incorporated for example into an appropriate container.

Latent heat storage elements of the type in question are now available for a wide range of target temperatures, including those from the applicant (brochure "va-Q-tec Packaging Portfolio, January 2011"). This provides latent heat storage elements for target temperatures of 37° C., 22° C., 4° C., 0° C., −19° C., −21° C. and −32° C. Other suppliers have comparable latent heat storage elements in their sales range, in some cases also for other target temperatures.

Latent heat storage elements of the type in question are used in the present field of application in thermally insulated containers, in particular for transport purposes. For example, this is applicable to the transport of temperature-sensitive products such as pharmaceuticals, bioengineering products, test equipment or samples for and from clinical studies, transplant materials or blood reserves. In this field of application, the optimum transport and storage temperature, which it is imperative to observe, is for example 2° C. to 8° C. Frequently, the products are only stable at all within a very narrow temperature range. For this reason, it is absolutely essential for these products to be transported and stored in this temperature range. Frequently, products of this kind, which are very sensitive to temperature in transport, must moreover on no account be allowed to freeze. In that case, temperatures below 0° C. must be reliably prevented.

In the case of the thermally insulated container discussed at the outset (WO 2004/104498 A2), the construction of the inner container and the arrangement of the individual inner container wall elements is fixedly predetermined from the outset. All the inner container wall elements are of like construction, preferably being vacuum insulation panels. If and to the extent that an individual inner container wall element can be removed and inserted, it is replaced by an inner container wall element of the same construction. This happens for example if a vacuum insulation panel is damaged.

In the known transport container system, the number of latent heat storage elements in the insert guides that are arranged on the inner faces on the inside of the inner container is variable. Different thermal requirements for the transported product may be taken into account by a larger or smaller number of latent heat storage elements in the transport container.

The above-described prior art relates to a transport container for temperature-sensitive transported product but not to a transport container system in the stricter sense.

By contrast, a transport container system of the type in question is known from DE 203 01 839 U1, which forms the starting point for the teaching of the present invention. The transport container system there has a container with an outer container that is made from thermally insulating material and an inner container that is made entirely from vacuum insulation panels. For a cuboid container, in that case six plate-like vacuum insulation panels are required for forming the inner container (on the base, on the four side walls and on the lid).

The prior art that is discussed above takes as a starting point the fact that there are provided on the walls of the container, preferably on all the inner faces, inner wall elements that may be removed from the container and inserted into the container, wherein each inner wall element has predetermined dimensions that are adapted to the associated inner face of the container. The concept of the known prior art is for only the inner wall elements on the two largest faces to take the form of vacuum insulation panels, whereas the inner wall elements on the four shorter lateral faces are equipped with thermally insulating elements of classic construction, for example made from conventional foam plastic.

The flexibility of the arrangement in this prior art is improved in that, instead of the inner container wall elements in the form of vacuum insulation panels, inner container wall elements in the form of cooling packs or heat retaining packs and of the same dimensions may be used.

In practice, it has been found that transport containers of the type in question must be set up for different thermal requirements, according to the actual use. In particular, the desired service period, that is to say the time for which the target temperature is maintained in the interior of the transport container intended to receive the transported product (conservation period), may also differ widely.

The teaching is thus based on the problem of constructing and further developing the transport container system of the type in question such that it may be adapted to different thermal requirements more flexibly than hitherto.

Finally, the teaching is also based on the problem of providing a correspondingly improved method for equipping a container of a transport container system of this kind.

SUMMARY

The problem indicated above is achieved by the present invention, in the case of a transport container system having the features set forth herein. Preferred embodiments and further developments form the subject matter of the subclaims that relate to the device.

The basic concept of the transport container system according to the invention consists first of holding in stock, at least in the case of some of the inner wall elements, a plurality of versions that have at least substantially the same dimensions but differ decisively from the thermal point of view. As a result of appropriately selecting the inner wall element to be used on the inner face provided from a stock of inner wall elements in different versions, a transport container that is perfectly adapted to the actual requirements can be realized.

According to the invention, the individual inner wall elements in the container can thus be selected such that the simple and reliable packing arrangement in the container is maintained unchanged, but in that compared with the thermally optimum equipment of the container one or more inner wall elements are replaced by inner wall elements of the same dimensions but in a thermally less demanding and thus less expensive version.

Specifically, it is provided according to the invention for an inner wall element that is provided in at least two versions to be in a first version a latent heat storage element or another heat storage element or a vacuum insulation panel, and in a second version a place-holder element having less thermal insulation effect than a vacuum insulation panel.

As an alternative, however, three versions of an inner wall element may also be provided, namely a latent heat storage element or another heat storage element in a first version, a vacuum insulation panel in a second version and a place-holder element having less thermal insulation effect in a third version.

A latent heat storage element of the type described in detail at the outset represents the most efficient form of heat storage element. In principle, however, other heat storage elements are also usable, for example a sensible heat storage element such as a cold pack or even a heat storage block of large mass (such as one made from stone or fireclay).

The system may further be modified for the place-holder element in that place-holder elements having less thermal insulation effect than a vacuum insulation panel may in turn be held in stock for selection, in different versions having different thermal insulation effects.

The decisive point is that at the position in the container that is provided for the relevant inner wall element, an inner wall element in one of the available versions may optionally be inserted. Thus, equipping of the container from the thermal point of view may be greatly modified. Inner wall elements having different thermal effects, for example thermal insulation on the one hand and heat storage on the other, may be exchanged for one another, or versions of different quality and different cost may be used out of a selection of different inner wall elements having the same thermal effect. In this way, the overall performance of the transport container in the version that is selected as appropriate within the system can be adjusted to the optimum.

Taking as a starting point for example a container whereof the inner wall elements in the thermally optimum version all take the form of vacuum insulation panels, it is possible to replace one or more of the inner wall elements by place-holder elements having less thermal insulation effect than a vacuum insulation panel, for example place-holder elements made from expanded polystyrene (EPS), expanded polypropylene (EPP), polyurethane (PU) or polyethylene combined with EPS, EPP or PU, to name just a few examples.

It is also possible to use place-holder elements made from other materials, often having even less thermal insulation effect, for example wood, in particular wood products such as chipboard or MDF boards, paper/cardboard or even lightweight building materials such as expanded clay slabs or lightweight building material slabs.

It is possible to modify the container described above in the thermally optimum version to influence the internal temperature by replacing some of the inner wall elements in the version as vacuum insulation panels by inner wall elements in the version as latent heat storage elements, or, in the event of lower requirements, as other heat storage elements.

In a particularly preferred embodiment of the transport container system according to the invention, the operation is in a plurality of layers, namely with an outer container and an inner container that is fitted inside the outer container. In this case, it is provided for the inner container for its part to comprise individual inner container wall elements that may be removed and inserted individually, and for the inner container wall elements to take the form of thermal insulation elements.

In this embodiment with outer container and inner container, the inner wall elements in the container lie on the inner faces of the inner container. The inner container, with its inner container wall elements, provides the thermal insulation, while the inner wall elements in the container may all be latent heat storage elements, or indeed in some cases latent heat storage elements and in some cases vacuum insulation panels or place-holder elements. Finally, in this variant it is also possible for all the inner wall elements to be vacuum insulation panels or place-holder elements, if a latent heat storage element is to be dispensed with entirely.

The essential point is that with the wealth of possible variations it is possible to meet precisely the thermal requirements that are made of the actual transport container for the desired application.

In general, it is advantageous if the inner wall elements and/or the inner container wall elements of different versions have at least approximately matching properties from a mechanical point of view. Regardless of which version of an inner wall element or inner container wall element is used, the element that is used likewise substantially fulfills the mechanical functions, for example the function of stiffening the container or the function of placing on top or fixing other elements.

With conventional cubic or cuboid containers, it is recommended that the inner wall elements and/or inner container wall elements should be of plate-like construction, and preferably should be beveled to fit one another at the mutually facing edges. In the last-mentioned and preferred case, there are the smallest possible gaps between the inner wall elements or inner container wall elements.

Exemplary models for constructions of other containers will be found in the prior art that was discussed at the outset (DE 203 01 839 U1). Explicit reference may be made here to the content disclosed therein.

The inner wall elements and/or inner container wall elements that serve as place-holder elements may moreover also have cutouts for receiving corresponding functional elements. This is difficult in the case of vacuum insulation panels, but may be realized satisfactorily in the case of other place-holder elements made from other materials. Thus, for example, cutouts may in turn be provided there for mounting latent heat storage elements or cooling packs or indeed for data carriers, documents or other measuring instruments.

Also the subject of the invention is a method for equipping a container of a transport container system.

The method according to the invention is characterized by the following method steps:

1. Providing a selection of inner wall elements for the container and in so doing providing at least some inner wall elements in at least two versions, namely a first version as a latent heat storage element or another heat storage element or a vacuum insulation panel, and a second version as a thermally insulating place-holder element having less thermal insulation than a vacuum insulation panel.

2. Selecting all the inner wall elements for the container from the inner wall elements that were provided in method step 1.

3. Inserting the inner wall elements in the respectively selected version, which were selected in method step 2., inside the container at the provided positions.

According to the invention, using the method an appropriate selection of inner wall elements in the container may be made. The simple and reliable packing arrangement in the container is maintained unchanged. From a thermal point of view, however, the container may be optimized over the complete range of possible equipment. Depending on the requirement profile for the product to be transported, the equipment may be more or less demanding from a thermal point of view and hence more or less expensive.

In a specified procedure, it may be recommended for the inner wall elements in method step 1. to be provided in three versions, namely as a latent heat storage element or another heat storage element in a first version, as a vacuum insulation panel in a second version and as a thermally insulating place-holder element having less thermal insulation effect than a vacuum insulation panel in a third version, or for the inner wall elements in method step 1. to be provided in four versions, namely as a latent heat storage element in a first version, as another heat storage element in a second version, as a vacuum insulation panel in a third version and as a thermally insulating place-holder element having less thermal insulation effect than a vacuum insulation panel in a fourth version.

A method according to the invention may also be adapted for a double-walled container having an outer container and an inner container. For this purpose, the following additional method steps may then be realized in the method:

4. Providing a selection of inner container wall elements for an inner container that may be fitted into an outer container of the container.

5. Selecting all the inner container wall elements for the inner container from the inner container wall elements that were provided in method step 4.

6. Fitting the inner container wall elements that were selected in method step 5. into the outer container at the provided positions.

Here, according to the preferred teaching it may be further provided for inner container wall elements that take the form of thermal insulation elements to be provided in method step 1., in which case the inner container wall elements are preferably provided in at least two versions, namely as a vacuum insulation panel in at least one version and as a thermally insulating place-holder element having less thermal insulation effect than a vacuum insulation panel in a second version.

The place-holder elements themselves may also take the form of different versions in the method according to the invention. In this context, it is provided according to the preferred teaching for the inner wall elements or inner container wall elements that take the form of thermally insulating place-holder elements to be provided, for their part, in different versions, namely a version made from plastics, in particular foam plastic, and/or a version made from paper/cardboard and/or a version made from wood, in particular wood products, and/or a version made from lightweight building material.

BRIEF DESCRIPTION OF THE DRAWINGS

The invention will be explained in more detail below with reference to a drawing, which illustrates merely preferred exemplary embodiments. In the drawing.

DETAILED DESCRIPTION

Figure 1:
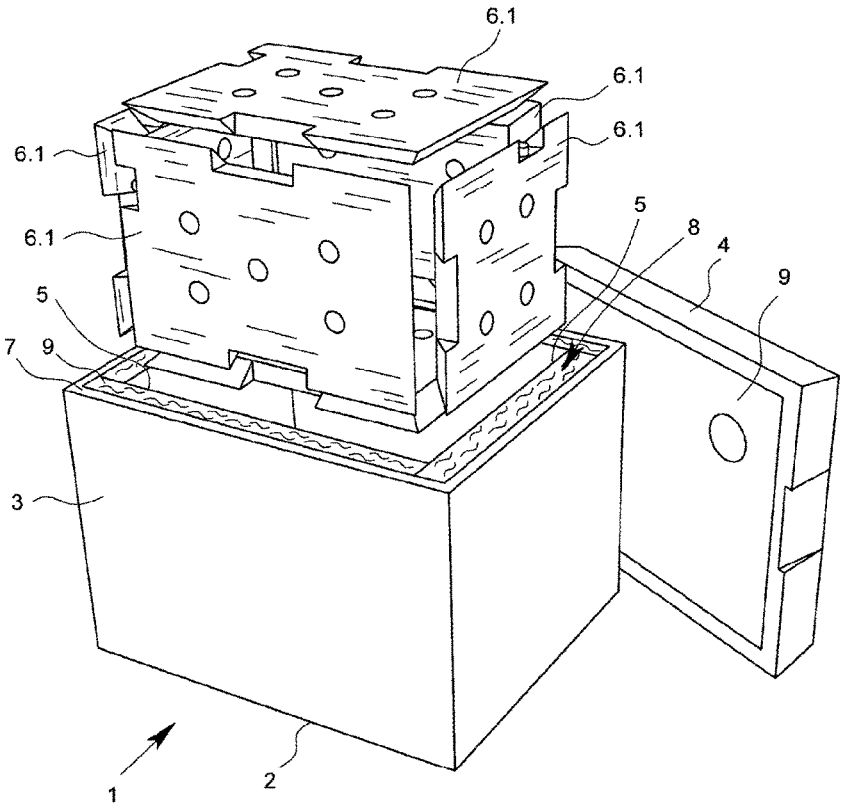
FIG. 1 shows, in a perspective view and in exploded illustration, a transport container of a transport container system according to the invention in a first configuration.

The transport container 1 of a transport container system according to the invention that is illustrated in FIG. 1 has first of all a base 2, a casing 3 and a lid 4. In the illustrated and preferred exemplary embodiment, the container 1 is cuboid in form. As a result, the casing 3 has two longitudinal sides and two transverse sides. In the general part of the description it has already been mentioned that other container shapes are also known, for example having a cylindrical casing. Reference may be made to the embodiments.

In the exemplary embodiment illustrated in FIG. 1, inner wall elements 6.1 are arranged on the walls of the container 1, on the inner faces 5 thereof, and these inner wall elements 6.1 may be removed from the container 1 and inserted into the container 1. Each inner wall element 6.1 has predetermined dimensions that are adapted to the associated inner face 5 of the container 1.

Since there are different versions of inner wall elements, the drawing includes the particular reference numerals of the different versions 6.1, 6.2 and 6.3.

In the exemplary embodiment illustrated in FIG. 1, a particular construction is presented in which the container 1 itself has an outer container 7 and an inner container 8 that is fitted inside the outer container 7. Thus, the construction of the container 1 in the exemplary embodiment illustrated corresponds to the construction that is present in the container of the prior art forming the starting point.

However, the invention also relates to a transport container system having at least one container 1 that comprises only the outer container 7, and so does not have an inner container 8 fitted inside.

In the exemplary embodiment illustrated, the outer container 7 is for example a container made from comparatively thin-walled foamed plastics material (e.g. an EPP molding). In the exemplary embodiment illustrated, the container 1 is in trough-like form with a lid 4 placed on top. In this case, the base 2 is made in one piece with the casing 3.

As already indicated in the general part of the description, there are also cabinet-like containers with a door that may be opened, to which the teaching of the present invention also applies in exactly the same way.

The container 1 illustrated in this manner may also be additionally provided with a cardboard packaging on the outside. The outer carton of the particular exemplary embodiment that is shaped in this way may bear advertising wording or user instructions.

As on the outside, in the interior of the container 1 there may additionally be provided an inner wall, for example an inner carton or an inliner that defines the interior of the container 1. This too is merely a preferred embodiment.

The preferred exemplary embodiment that is illustrated in FIG. 1 shows a total of six plate-like inner wall elements 6.1. Each of the inner wall elements 6.1 here is a latent heat storage element. They are thus inner wall elements 6.1 in a first version, as latent heat storage elements.

Figure 2:
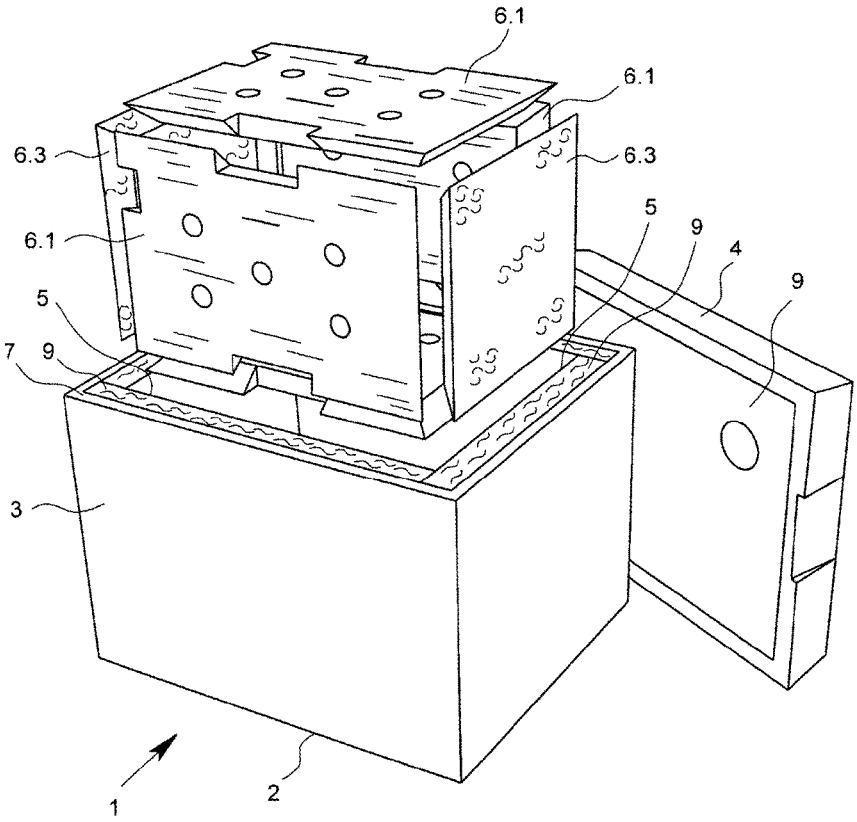
FIG. 2 shows, in a perspective view and in exploded illustration, a transport container of a transport container system according to the invention in a second configuration.

FIG. 2 shows the exemplary embodiment from FIG. 1 in modified form. Here, some inner wall elements 6.1 in the first version, as latent heat storage elements, are inner wall elements 6.3 in a version as place-holder elements having less thermal insulation effect than a vacuum insulation panel. In concrete terms, at the bottom, at the base 2, and at the top, at the lid 4, there are visible in each case an inner wall element 6.1 in the form of a latent heat storage element, and to left and right on the longitudinal sides there are in each case an inner wall element 6.1 in the form of a latent heat storage element, and at the end face there is an inner wall element 6.3 in the form of a place-holder element. The latter, end-face inner wall elements 6.3 of the third version replace the inner wall element 6.1 from FIG. 1. This is possible because the inner wall elements that have been replaced within the scope of the transport container system according to the invention have at least substantially the same dimensions.

Figure 3:
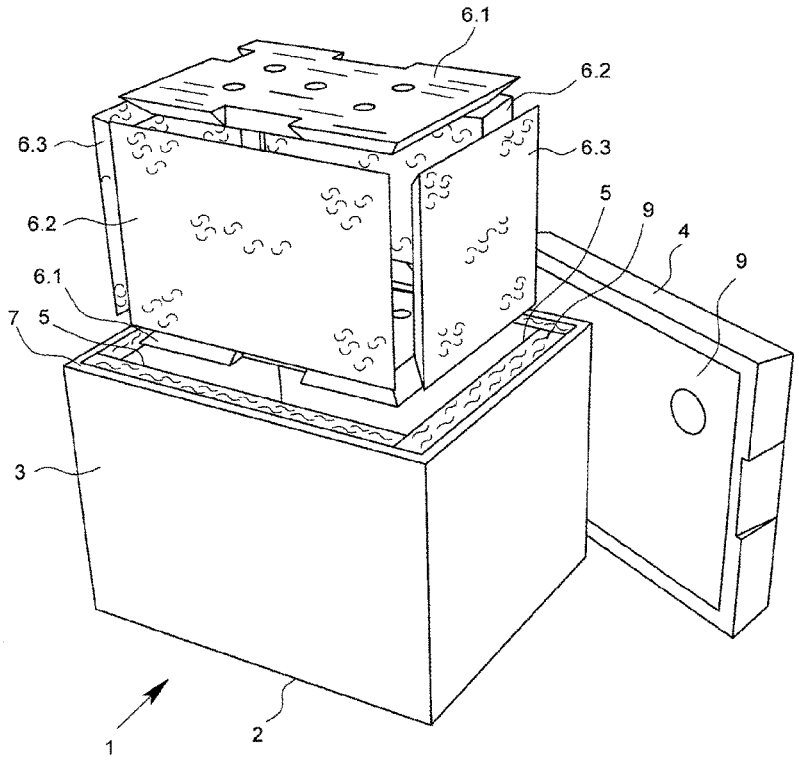
FIG. 3 shows, in a perspective view and in exploded illustration, a transport container of a transport container system according to the invention in a third configuration.

In the exemplary embodiment illustrated in FIG. 3, which is further modified, furthermore the inner wall elements 6.1 that are associated with the longitudinal sides of the casing 3 have been replaced in the version as latent heat storage elements by inner wall element 6.2 in the version as vacuum insulation panels. Thus, on the large, longitudinal sides of the casing 3 of the container 1, the heat storage elements have also been replaced by thermal insulation elements, but by the most efficient form of thermal insulation elements, namely by inner wall elements 6.2 in the second version, as vacuum insulation panels. Thus, thermal insulation is particularly efficient over the large surfaces, and over the smaller, end faces the use of inner wall elements 6.3 in the third version, as place-holder elements having less thermal insulation effect, is possible without impairing to too great an extent the overall performance of the transport container that is actually constructed in this way.

As has already been explained, in the exemplary embodiment illustrated in FIGS. 1 to 3 the container 1 is constructed from outer container 7 and inner container 8.

It will be seen here that the inner container 8 for its part comprises individually removable inner container wall elements 9. All the inner container wall elements 9 take the form of thermal insulation elements here. In the preferred exemplary embodiment illustrated here, all the inner container wall elements 9 are of matching construction, namely as inner container vacuum insulation panels. Here too, according to the invention a modification may be made, namely in that it may be provided for there to be a plurality of versions, at least one version as an inner container vacuum insulation panel and a further version of at least substantially the same dimensions as a place-holder element having less thermal insulation effect than a vacuum insulation panel. In particular, it is possible for an inner container wall element 9 also to take the form of a latent heat storage element or another heat storage element.

In the embodiment as a place-holder element having less thermal insulation effect than a vacuum insulation panel, further steps may be introduced in the inner wall elements 6.1, 6.2, 6.3 and in the inner container wall elements 9, for example place-holder elements having different levels of thermal insulation effect. This may consist for example in the fact that place-holder elements made from different materials (well foamed plastics, wood, paper/cardboard) may optionally be used.

It is moreover essential that, according to the preferred teaching, the inner wall elements 6.1, 6.2, 6.3 and/or the inner container wall elements 9 in different versions have at least approximately matching properties from a mechanical point of view.

In the case of the inner container 8, the inner container wall elements 9 are plate-like in form. They are shaped as vacuum insulation panels to be smooth and plate-like, and so are not beveled at the edges. Rather, they are incorporated into the outer container 7 butting flat.

By contrast, the inner wall elements 6.1, 6.2, 6.3 in the interior of the inner container 8 are beveled to fit one another at the mutually facing edges, as is readily seen here from the drawing.

Figure 4:
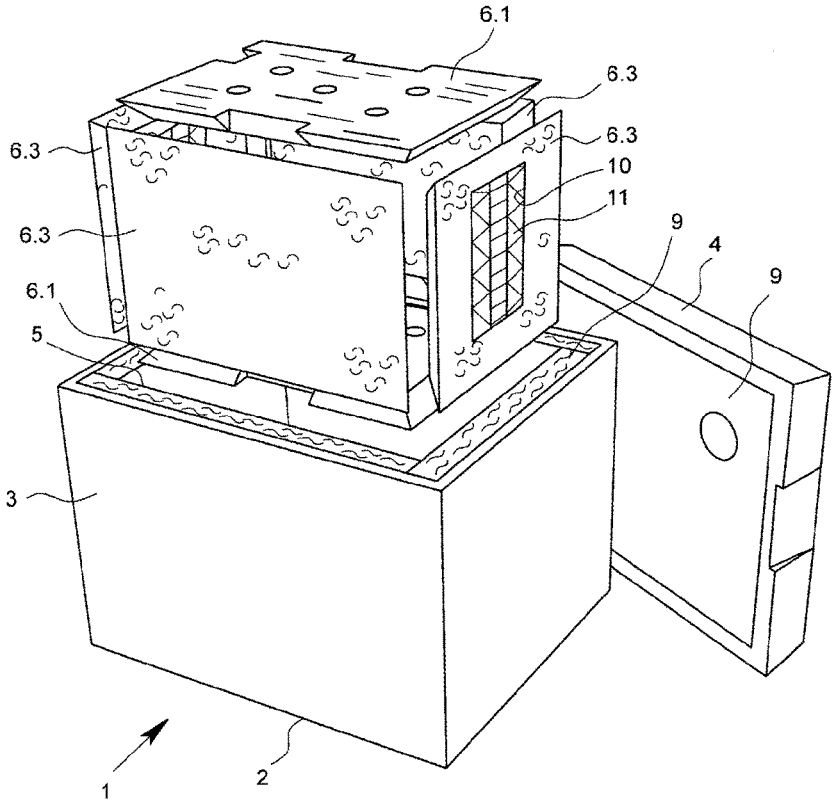
FIG. 4 shows, in a perspective view and in exploded illustration, a transport container of a transport container system according to the invention in a fourth configuration.

The further modified exemplary embodiment illustrated in FIG. 4 makes it clear that it is further possible, according to the preferred teaching, for at least one of the inner wall elements 6.3 and/or inner container wall elements 9 that take the form of place-holder elements to have at least one cutout 10 for receiving another type of functional element 11. The functional elements 11 that are indicated here are, in the concrete exemplary embodiment, water-based cooling packs that have a different target temperature from the latent heat storage elements that are positioned as inner wall elements 6.1 on the base 2 and the lid 4 of the container 1. As a result, particular thermal boundary conditions can be achieved in the interior of the container 1 for the transported product located there.

In principle, it is possible in particular in the case of the inner wall elements 6.3 and/or the inner container wall elements 9 that take the form of place-holder elements to be configured in an embodiment that stores moisture and/or regulates moisture.

The transport container system according to the invention may be modified for example as follows:

In the basic shape, all the inner container wall elements 9 are used in the version as vacuum insulation panels. All six inner wall elements are inner wall elements 6.1 in the form of latent heat storage elements.

In a further embodiment, two of the six latent heat storage elements are replaced such that four inner wall elements 6.1 are provided in the form of latent heat storage elements and two inner wall elements 6.2 in the form of vacuum insulation panels are provided or two inner wall elements 6.3 of the same dimensions in the form of place-holder elements having less thermal insulation effect than a vacuum insulation panel are provided (see FIG. 2).

In the next stage, four of the in principle six possible latent heat storage elements are replaced by vacuum insulation panels or place-holder elements (see FIG. 3). Finally, there is also a stage in which there are no latent heat storage elements in the interior of the container 1 at all. In that case, only inner wall elements 6.2 in the form of vacuum insulation panels or inner wall elements 6.3 in the form of place-holder elements are provided there.

The inner container wall elements 9 may undergo corresponding modifications and at the end faces for example replace the relatively expensive vacuum insulation panels by place-holder elements having less thermal insulation than a vacuum insulation panel.

The cutouts 10 indicated in FIG. 4 may be used for functional elements 11 of any kind. They do not need to be the water cooling packs that are actually shown there. For example, these inner wall elements 6.3 in the form of place-holder elements may also be constructed simply as blank plastic sheaths, possibly open on one side. A document that is required or advantageous for the transported product may then for example be located in a plastic sheath of this kind.

In the general part of the description, some further indications are given of the utilization of the cutouts 10, and reference may be made here thereto.

Essential to the teaching of the invention is the universal exchangeability of all the inner wall elements of one version by inner wall elements of another version, because of the matching and substantially like dimensions and the preferably also present matching properties from a mechanical point of view. This applies correspondingly to the inner container wall elements 9.

The statements above on the transport container system also include at the appropriate points in each case the statements on the method according to the invention for equipping a container 1 of a transport container system of this kind. No additional statements are required in this regard.

The invention claimed is:

1. A transport container system having at least one container that has a base, a casing and a lid, having inner wall elements that are arranged on walls of the container on inner faces thereof and are removed from the container and inserted into the container, wherein each inner wall element has predetermined dimensions that correspond to the associated inner face of the container, wherein at least in the case of some of the inner wall elements, a plurality of versions having the predetermined dimensions are part of the transport container system, the inner wall elements in the plurality of versions are exchangeable for one another in the container, each of the inner wall elements is a heat storage element or a vacuum insulation panel or a place-holder element having less thermal insulation effect than the vacuum insulation panel, the container has an outer container and an inner container that is fitted inside the outer container, the inner container comprises inner container wall elements that are removed and inserted individually, the inner container wall elements take the form of heat insulation elements, and wherein at least two versions of the inner container wall elements are provided, namely at least one version as an inner container vacuum insulation panel and a further version as a place-holder element having less thermal insulation than the vacuum insulation panel.

2. The transport container system as claimed in claim 1, wherein the inner wall elements and the inner container wall elements have matching properties.

3. The transport container system as claimed in claim 1, wherein the inner wall elements and the inner container wall elements are of plate-like construction, and are beveled to fit one another at mutually facing edges.

4. The transport container system as claimed in claim 1, wherein the inner wall elements or the inner container wall elements that take the form of place-holder elements are made from plastics, from paper/cardboard, from wood, or from lightweight building material.

5. The transport container system as claimed in claim 1, wherein at least one of the inner wall elements and the inner container wall elements that take the form of place-holder elements has at least one cutout for receiving a functional element.

6. The transport container system as claimed in claim 1, wherein at least one of the inner wall elements and the inner container wall elements that take the form of a place-holder element is made from a material that stores and regulates moisture.

7. A method for equipping a container of a transport container system, wherein the container has a base, a casing and a lid, wherein inner wall elements are arranged on walls of the container on inner faces thereof, wherein each of the inner wall elements has predetermined dimensions that correspond to the associated inner face of the container, and wherein the inner wall elements are inserted into the container and removed from the container, the method comprising:

a. providing a selection of the inner wall elements for the container, wherein the inner wall elements are provided in two versions, namely as a heat storage element or a vacuum insulation panel in a first version, and as a thermally insulating place-holder element having less thermal insulation than the vacuum insulation panel in a second version;

b. selecting all the inner wall elements for the container from the inner wall elements that were provided in method step a; and c. inserting the inner wall elements which were selected in method step b, inside the container.

8. The method as claimed in claim 7, wherein the inner wall elements in method step a are provided in three versions, namely as a latent heat storage element or another heat storage element in a first version, as a vacuum insulation panel in a second version and as a thermally insulating place-holder element having less thermal insulation effect than the vacuum insulation panel in a third version, or in that the inner wall elements in method step a are provided in four versions, namely as a latent heat storage element in a first version, as another heat storage element in a second version, as a vacuum insulation panel in a third version and as a thermally insulating place-holder element having less thermal insulation effect than the vacuum insulation panel in a fourth version.

9. A method for equipping a container of a transport container system, wherein the container has a base, a casing and a lid, wherein inner wall elements are arranged on walls of the container on inner faces thereof, wherein each of the inner wall elements has predetermined dimensions that correspond to the associated inner face of the container, and wherein the inner wall elements are inserted into the container and removed from the container, the method comprising:

a. providing a selection of the inner wall elements for the container, each of the inner wall elements being a heat storage element or a vacuum insulation panel or a thermally insulating place-holder element having less thermal insulation than the vacuum insulation panel;

b. selecting all the inner wall elements for the container from the inner wall elements that were provided in method step a;

c. inserting the inner wall elements which were selected in method step b, inside the container;

d. providing a selection of inner container wall elements for an inner container that are fitted into an outer container of the container;

e. selecting all the inner container wall elements for the inner container from the inner container wall elements that were provided in method step d; and f. fitting the inner container wall elements that were selected in method step e into the outer container.

10. The method as claimed in claim 9, wherein the inner container wall elements that take the form of thermal insulation elements are provided in method step a, in which case the inner container wall elements are provided in at least two versions, namely as a vacuum insulation panel in at least one version and as a thermally insulating place-holder element having less thermal insulation effect than the vacuum insulation panel in a second version.

11. The method as claimed in claim 9, wherein the inner wall elements or the inner container wall elements that take the form of thermally insulating place-holder elements are made from plastics, from paper/cardboard or from wood, or from lightweight building material.

12. A transport container system having at least one container that has a base, a casing and a lid, having inner wall elements that are arranged on walls of the container on inner faces thereof and are removed from the container and inserted into the container, wherein each inner wall element has predetermined dimensions that correspond to the associated inner face of the container, wherein at least in the case of some of the inner wall elements, a plurality of versions having the predetermined dimensions are part of the transport container system, the inner wall elements in the plurality of versions are exchangeable for one another in the container, each of the inner wall elements is a heat storage element or a vacuum insulation panel or a place-holder element having less thermal insulation effect than the vacuum insulation panel and each of the inner wall elements is the place-holder element having less thermal insulation effect that a vacuum insulation panel.

13. A transport container system having at least one container that has a base, a casing and a lid, having inner wall elements that are arranged on walls of the container on inner faces thereof and are removed from the container and inserted into the container, wherein each inner wall element has predetermined dimensions that correspond to the associated inner face of the container, wherein at least in the case of some of the inner wall elements, a plurality of versions having the predetermined dimensions are part of the transport container system, the inner wall elements in the plurality of versions are exchangeable for one another in the container, each of the inner wall elements is a heat storage element or a vacuum insulation panel or a place-holder element having less thermal insulation effect than the vacuum insulation panel and the inner wall elements are a combination of the heat storage element and the place-holder element having less thermal insulation effect than a vacuum insulation panel.

14. A transport container system having at least one container that has a base, a casing and a lid, having inner wall elements that are arranged on walls of the container on inner faces thereof and are removed from the container and inserted into the container, wherein each inner wall element has predetermined dimensions that correspond to the associated inner face of the container, wherein at least in the case of some of the inner wall elements, a plurality of versions having the predetermined dimensions are part of the transport container system, the inner wall elements in the plurality of versions are exchangeable for one another in the container, each of the inner wall elements is a heat storage element or a vacuum insulation panel or a place-holder element having less thermal insulation effect than the vacuum insulation panel and the inner wall elements are a combination of the heat storage element, the vacuum insulation panel, and the place-holder element having less thermal effect than the vacuum insulation panel.

* * * * *